US010480450B2

(12) United States Patent
Boehmer et al.

(10) Patent No.: US 10,480,450 B2
(45) Date of Patent: Nov. 19, 2019

(54) INTERNAL COMBUSTION ENGINE WITH PARTIAL PISTON TWISTING

(71) Applicant: DEUTZ Aktiengesellschaft, Cologne (DE)

(72) Inventors: Andreas Boehmer, Cologne (DE); Harald Reuter, Cologne (DE); Werner Lemme, Roesrath (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 15/848,180

(22) Filed: Dec. 20, 2017

(65) Prior Publication Data

US 2018/0171930 A1 Jun. 21, 2018

(30) Foreign Application Priority Data

Dec. 20, 2016 (DE) ..... 10 2016 015 112

(51) Int. Cl.

| | |
|---|---|
| ***F02F 7/00*** | (2006.01) |
| ***F02B 75/22*** | (2006.01) |
| ***F02B 75/32*** | (2006.01) |
| ***F02B 75/20*** | (2006.01) |

(52) U.S. Cl.

CPC ..... *F02F 7/0019* (2013.01); *F02B 75/20* (2013.01); *F02B 75/228* (2013.01); *F02B 75/32* (2013.01)

(58) Field of Classification Search

CPC ..... F02B 75/20; F02B 75/048; F02B 75/047; F02B 75/265; F16C 3/20; F16C 9/02

See application file for complete search history.

(56) References Cited

U.S. PATENT DOCUMENTS

| | | | | |
|---|---|---|---|---|
| 1,998,706 | A | 4/1935 | Campbell | |
| 4,708,096 | A | 11/1987 | Mroz | |
| 4,945,866 | A * | 8/1990 | Chabot, Jr. | F02B 41/00 123/53.1 |
| 5,092,293 | A * | 3/1992 | Kaniut | F16F 15/265 123/192.2 |
| 6,202,622 | B1 * | 3/2001 | Raquiza, Jr. | F02B 75/32 123/197.4 |
| 7,044,088 | B2 | 5/2006 | Aketa et al. | |
| 8,739,758 | B2 * | 6/2014 | Friedmann | F02D 17/02 123/197.1 |

(Continued)

FOREIGN PATENT DOCUMENTS

| | | |
|---|---|---|
| CH | 548537 | 4/1974 |
| CN | 2093906 U | 1/1992 |

(Continued)

OTHER PUBLICATIONS

Motortechnische Zeitschrift (MTZ) 51 (1990) 10, p. 410 ff., see English Abstract in Article and also specification of application.

(Continued)

*Primary Examiner* — Long T Tran

(74) *Attorney, Agent, or Firm* — Davidson, Davidson & Kappel, LLC

(57) ABSTRACT

A reciprocating internal combustion engine having a line of cylinders arranged in parallel which are joined via connecting rods and pistons by means of a crank drive that is jointly mounted in a crankshaft bearing, whereby the crankshaft bearing of the crank drive can have been offset relative to the cylinder axis.

9 Claims, 4 Drawing Sheets

(56) References Cited

U.S. PATENT DOCUMENTS

| | | | | |
|---|---|---|---|---|
| 9,016,258 | B2 * | 4/2015 | Wilkins | F02B 75/045 123/197.4 |
| 9,046,126 | B2 * | 6/2015 | Wilkins | F16C 7/04 |
| 9,341,110 | B2 * | 5/2016 | Wilkins | F02B 41/04 |
| 2007/0028866 | A1 * | 2/2007 | Lindsay | F01L 7/04 123/51 BA |
| 2007/0256650 | A1 | 11/2007 | Ethelmer Pflughoeft | |
| 2011/0005489 | A1 * | 1/2011 | Lewis | F02F 7/0019 123/193.1 |
| 2011/0226220 | A1 * | 9/2011 | Wilkins | F02B 75/044 123/48 B |
| 2012/0285412 | A1 * | 11/2012 | Brendel | F02B 41/04 123/192.2 |
| 2013/0042828 | A1 | 2/2013 | Oezdamar | |
| 2013/0312710 | A1 * | 11/2013 | Inden | F02B 75/048 123/48 B |
| 2017/0276213 | A1 * | 9/2017 | Sano | F02B 61/02 |

FOREIGN PATENT DOCUMENTS

| | | | | |
|---|---|---|---|---|
| DE | 4037272 | A1 * | 6/1991 | F02B 75/065 |
| DE | 602004001614 | | 7/2007 | |
| DE | 197 16 274 | B4 | 5/2012 | |
| JP | H09264155 | A | 10/1997 | |
| JP | 2006057536 | A | 3/2006 | |
| WO | WO 01/49974 | A1 | 7/2001 | |
| WO | WO 2011/126464 | A1 | 10/2011 | |

OTHER PUBLICATIONS

Motortechnische Zeitschrift (MTZ) 52 (1991) 3, p. 100 ff, see English Abstract in Article and also specification of application.

Motortechnische Zeitschrift (MTZ) 62 (2001) 4, p. 280 ff, see specification of application.

* cited by examiner

INTERNAL COMBUSTION ENGINE WITH PARTIAL PISTON TWISTING

This claims the benefit of German Patent Application DE 10 2016 015 112.9, filed Dec. 20, 2016 and hereby incorporated by reference herein.

The invention relates to an internal combustion engine with partial piston twisting, which translates into a shortened engine.

BACKGROUND

A known way to reduce friction forces and thus to lower fuel consumption consists of twisting crank drives, namely, offsetting the cylinders with respect to the center of the crankshaft. In this process, the cylinder axis is offset by a few millimeters relative to the crankshaft.

The German technical journal Motortechnische Zeitschrift (MTZ) 51 (1990) 10, p. 410ff., describes a Volkswagen VR6 engine having a twisted design, which translates into a shortened housing.

A symmetrically twisted crank drive for the above-mentioned VR6 engines is also known from MTZ 52 (1991) 3, p. 100ff.

Such a compact engine is also disclosed in German patent specification DE 197 16 274 B4.

Moreover, MTZ 62 (2001) 4, p. 280ff. describes the construction of compact V or W engines having a twisted design.

The drawback here is that it is difficult to mill such crankcases since this leads to slanted pistons and heads. In this configuration, the cylinders are positioned so as to be slanted relative to the cover surface of the cylinder crankcase. The disadvantages of this configuration lie in the mass balance or in the balancing of moments, which are not comparable to those of an inline engine, in the more laborious processing entailed by the slanted pistons, and in the associated special parts, for example, the piston and the head.

When it comes to producibility, mention should be made of the design of the water jacket, for example, the formation of the core between the cylinders, as well as of the wall thickness of the cylinder liners for rising combustion pressures. Consequently, a large cylinder distance should be seen here as being positive.

On the other hand, the total length of the engine, in other words, the compactness of the aggregate, is a very important aspect so that here, the smallest possible cylinder distance is positive.

SUMMARY OF THE INVENTION

It is an object of the present invention to avoid the above-mentioned drawbacks and to find an optimum among the above-mentioned cylinder distances.

This objective is achieved by means of a reciprocating internal combustion engine having a line of cylinders arranged in parallel which are joined via connecting rods and pistons by means of a crank drive that is jointly mounted in a crankshaft bearing, whereby the crankshaft bearing of the crank drive can have been offset relative to the cylinder axis.

It is also provided according to the invention that the offsetting of the crank drive takes place on the pressure side, which entails advantages when it comes to the forces on the piston side and to the piston skirt friction.

In another advantageous embodiment, it is provided that the offsetting takes place on the counter-pressure side.

According to the invention, it is provided that every other cylinder or its cylinder axis is offset relative to the crankshaft bearing. If only every other cylinder is twisted, it is true that only half of the potential for reducing fuel consumption is utilized, but the length of the engine can be reduced. This can translate into a decisive advantage if an engine has to fit into the existing installation space of a given machine.

It is likewise provided according to the invention that the cylinders alternatingly have a positive offset and subsequently a negative offset, as seen in the lengthwise direction of the internal combustion engine. In a refinement of this idea, the cylinders, which are not twisted here, could also be imparted with a negative twist. This allows the engine to be shortened further.

In another advantageous refinement, it is provided that the cylinders are arranged off-center relative to the center of the crankshaft and as seen in the lengthwise direction of the internal combustion engine.

A refinement according to the invention provides that the pistons that are joined to the connecting rod by means of a piston pin are arranged in such a way that the piston pin is situated outside of the mid-plane of the piston.

It is also provided according to the invention that the pistons that are joined to the connecting rod by means of a piston pin are arranged in such a way that the piston pin is situated outside of the mid-plane of the piston on the counter-pressure side.

Another advantageous refinement provides that the pistons that are joined to the connecting rod by means of a piston pin are arranged in such a way that the piston pin is situated outside of the mid-plane of the piston on the pressure side.

BRIEF DESCRIPTION OF THE DRAWINGS

Additional advantages and features of the invention ensue from the embodiment explained below. The following is shown.

DETAILED DESCRIPTION

Figure 1:
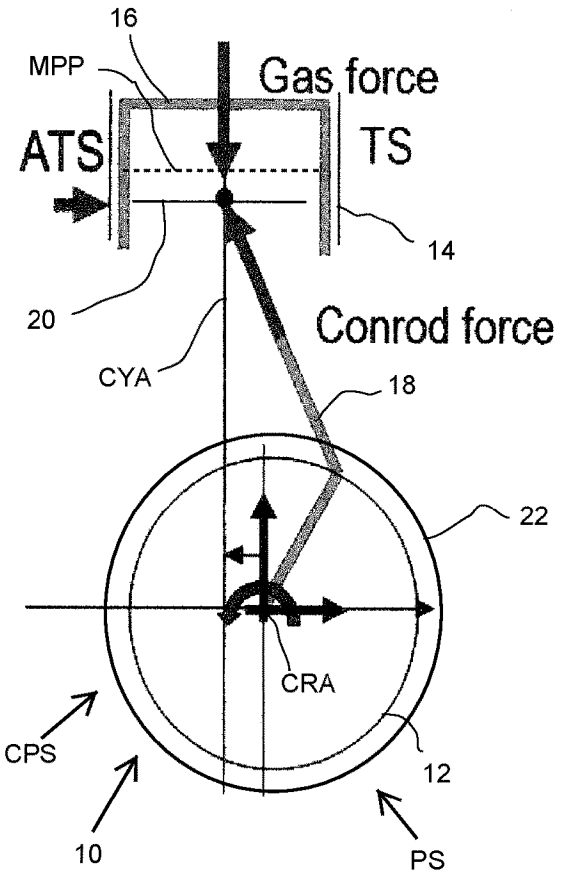
FIG. 1 twisting of the crank and its influence on the friction.
Figure 1:
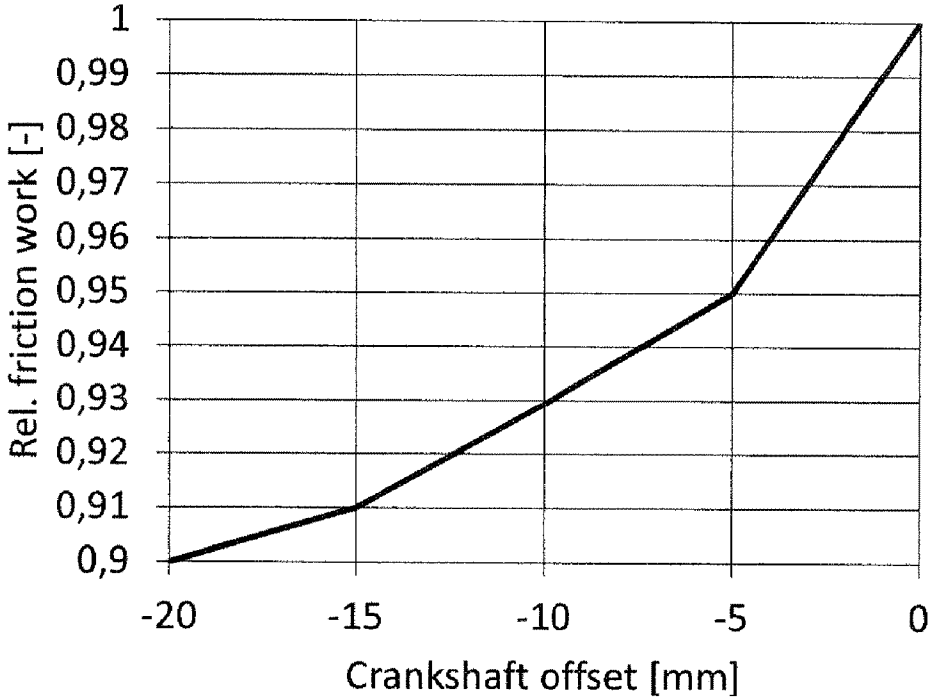

In the case of a twisted crank drive 10 as shown in FIG. 1, the axis CRA of the crankshaft 12 is no longer situated in the longitudinal axis CYA of the cylinder 14 but rather, it is arranged so as to be offset laterally. The twisting can be executed in the direction of the pressure side PS or of the counter-pressure side CPS, whereby the twisting on the pressure side is defined as being positive. The twist gives rise to changed courses of the movement and of the load of the crank drive. Twisting towards the pressure side of the piston 16 brings about a lesser slanted positioning of the connecting rod 18 during the combustion cycle, thereby reducing the forces on the piston side and thus reducing the piston skirt friction. In contrast to this, twisting towards the counter-pressure side translates into increased piston skirt friction. The term "axial shifting" refers to the offsetting of the piston pin 20 away from the mid-plane MPP of the piston or away from the mid-plane MPC of the cylinder. As is the case with the twisting, axial shifting can be carried out in the direction of the pressure side or counter-pressure side of the piston; axial shifting in the direction of the pressure side of the piston is defined as being positive—as is the case with the twisting. The term "axial shifting" designates the offsetting of the axis of the piston pin. The twisting and the axial shifting have the same effects on the piston travel, and for this reason, the axial shifting and the twisting always have to be taken into account together when calculating the piston travel.

The twisting towards the pressure side of the piston was defined as being "positive".

For the axial shifting, the offsetting towards the pressure side was also defined as being "positive".

As is the case with twisting, axial shifting has an impact on the course of the movement. Owing to the axial shifting on the counter-pressure side, the piston moves more in the center of the cylinder, which translates into an improved sealing effect on the part of the piston rings and which counters the deposit of carbon in the area of the heat dam. This type of axial shifting is called thermal axial shifting. Due to the axial shifting on the pressure side, which is referred to as noise axial shifting, an additional moment is generated on the piston. This changes the course of the slideway force and brings about a change in the point of contact of the piston already before the top dead center (TDC). Owing to the axial shifting, a moment is exerted on the piston before the top dead center (TDC). This causes a tilting movement of the piston, the lower piston skirt makes contact with the pressure side before the TDC. An axial shifting by 0.5% to 2% of the piston diameter gives rise to an earlier change in the point of contact. This makes it possible to reduce the piston tilting noise. Unlike the twisting, the axial shifting is implemented within the range of tenths of a millimeter. Twisting and axial shifting and can be carried out on their own or else in a combination of both methods. As a result, the described effects can be combined as desired, depending on the application case. An additional axial shifting of the offset crank drive has an influence on the distance of the piston pin from the mid-point of the orbit of the large connecting rod eye. If the axial shifting is in the direction of the offsetting, the above-mentioned distance diminishes. This approximates the movement of a conventional crank drive. Therefore, an axial shifting on the offsetting side corresponds to a shortening of the length of the offset and consequently accounts for a reduction in all of the changes brought about by the offsetting. Axial shifting counter to the offsetting direction causes an increase in the distance between the piston pin and the mid-point of the orbit of the large connecting rod eye and consequently intensifies the effects of an offset crank drive.

The distance of the cylinders of an internal combustion engine has an influence on a number of characteristic quantities of the engine. These include, among others, the total length of the engine, the producibility of the parts, and the durability of the parts. By way of an example, mention is hereby made of the cylinder crankcase.

A combination of twisting and axial shifting utilizes the effects of the axial shifting, namely, the reduction in piston tilting noises or the improvement of the sealing capacity of the piston ring due to the off-center introduction of force into the piston pin, all of which cannot be attained by twisting alone. Due to the geometric limitation of the degree of axial shifting in the piston, the effects that can be achieved with a changed piston travel and with the thus-changing connecting rod angle before or after the TDC are not possible in the same manner as afforded by twisting. Approximately 40% to 50% of the total friction of the diesel engine can be ascribed to the group consisting of the piston and the connecting rod.

The friction of the piston/connecting rod group is made up of the friction in the connecting rod bearing, the friction of the pendulum movement of the piston pin, the piston ring friction and the friction of the piston skirt on the cylinder liner. The friction of the piston skirt depends on the coefficient of friction and thus on the pairing of materials, on the oil viscosity and sliding speed as well as on the lateral guiding force or on the piston normal force, which is calculated on the basis of the cylinder pressure and of the inertia force of the oscillating masses when the connecting rod is placed in a slanted position relative to the crankshaft position. The total friction of the piston/connecting rod group is essentially determined by the friction of the piston skirt on the cylinder wall, which depends on the piston normal force and on the friction conditions. The piston normal force, in turn, is obtained on the basis of the resulting piston force—the sum of the gas force and inertia force—and on the basis of the angle created by the slanted positioning of the connecting rod. Twisting on the pressure side brings about a smaller deflection of the connecting rod after the TDC, thus reducing the piston normal force during the expansion phase. During the compression, the piston normal force increases due to the greater slanted positioning of the connecting rod. The potential for reducing the friction is dependent on the gas force and on the inertia force on the piston. Depending on the ratio of the gas force to the inertia force—which is a function of the load and rotational speed—on the piston, different effects on the friction are achieved by the piston normal force. The friction-reducing effect increases as the cylinder pressure rises and it drops as the rotational speed increases. At full load, twisting amounting to about 14 mm yields the greatest friction gain in the piston/connecting rod group. When it comes to partial-load operation, the optimum degree of twisting for reducing the friction is approximately 8 mm. Therefore, an effective compromise can be a twisting degree of 10 mm to 12 mm.

Figure 2:
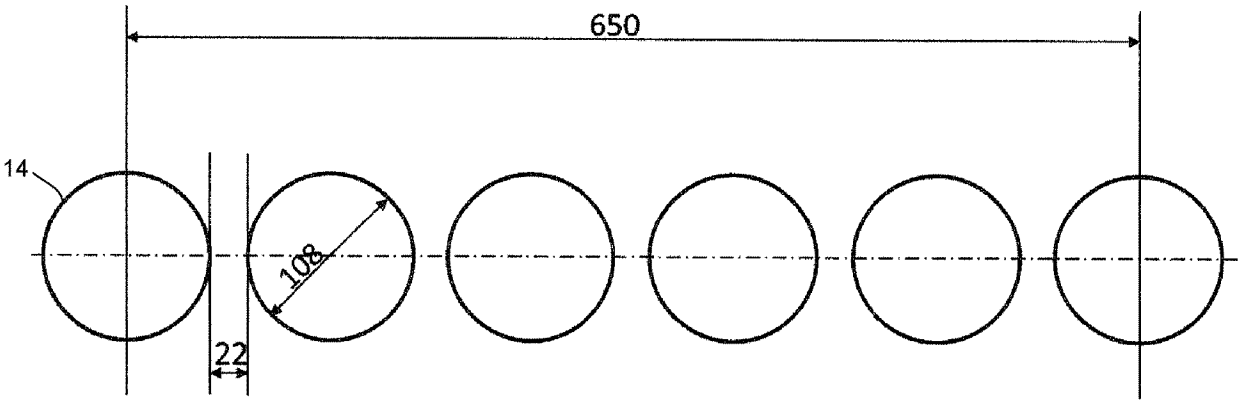
FIG. 2 untwisted or uniformly twisted crank drive.

FIG. 2 shows an untwisted or uniformly twisted crank drive. The present invention puts forward a 4-cylinder or 6-cylinder inline engine which has the shortest possible installation length but which allows producibility involving a greater cylinder distance. There is a need for a smaller bearing distance of the crankshaft 12 bearing relative to the cylinder distance. This is put forward by an embodiment of the cylinder crankcase having a cylinder arrangement in which the center of the cylinder 14 does not fall at the center of the crankshaft 12, but rather, in which it is offset by a few millimeters thereto. Since the centers of the adjacent cylinders 14 are mutually offset relative to the center of the crankshaft 12, a larger distance is created between the cylinder diameters in comparison to the bearing distances of the crankshaft bearing 22 (FIG. 1).

Figure 3:
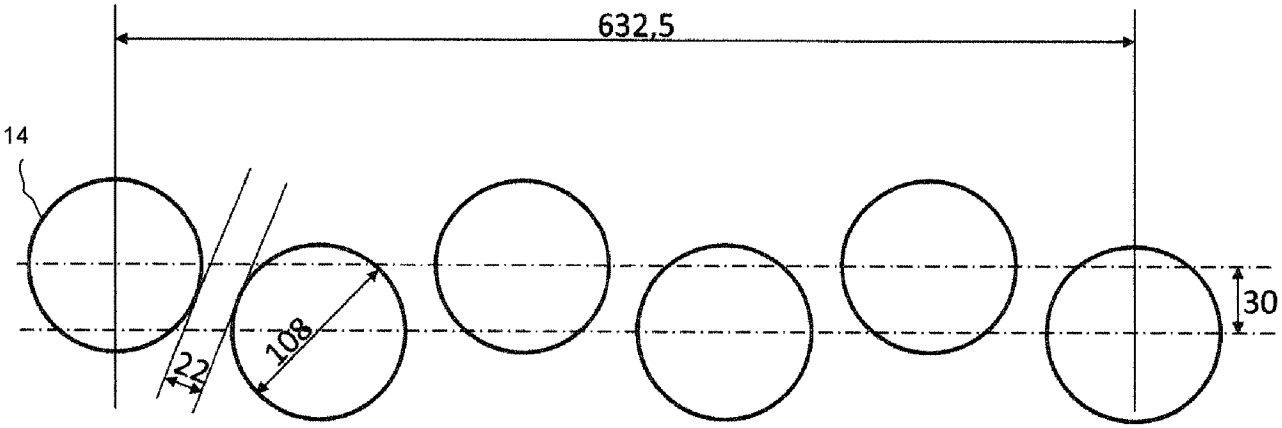
FIG. 3 crank drive with every other cylinder twisted.

FIG. 3 shows a crank drive with every other cylinder 14 twisted.

Figure 4:
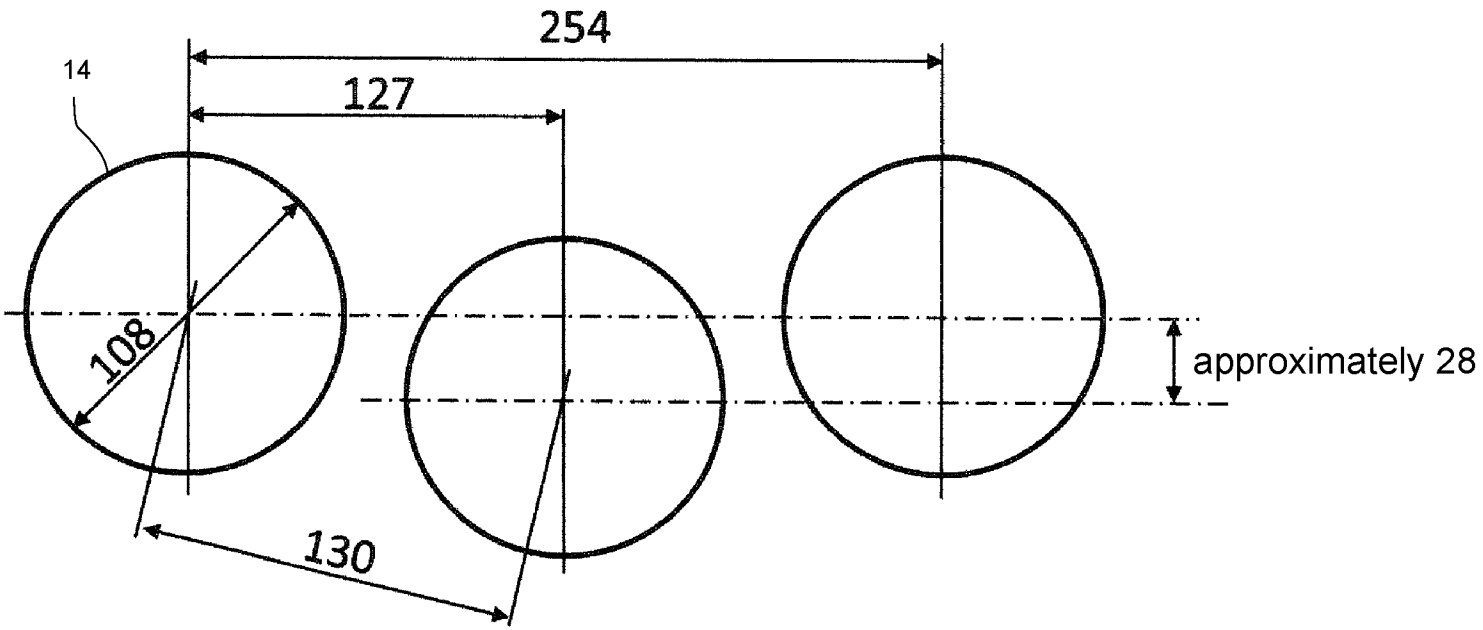
FIG. 4 enlarged view of FIG. 3.

FIG. 4 shows an enlarged view of FIG. 3 and it explains the arrangement on the basis of a dimension example in which the bearing distance—which determines the length of the engine—amounts to 127 mm; the cylinder distance, however, was selected to be 140 mm.

Figure 5:
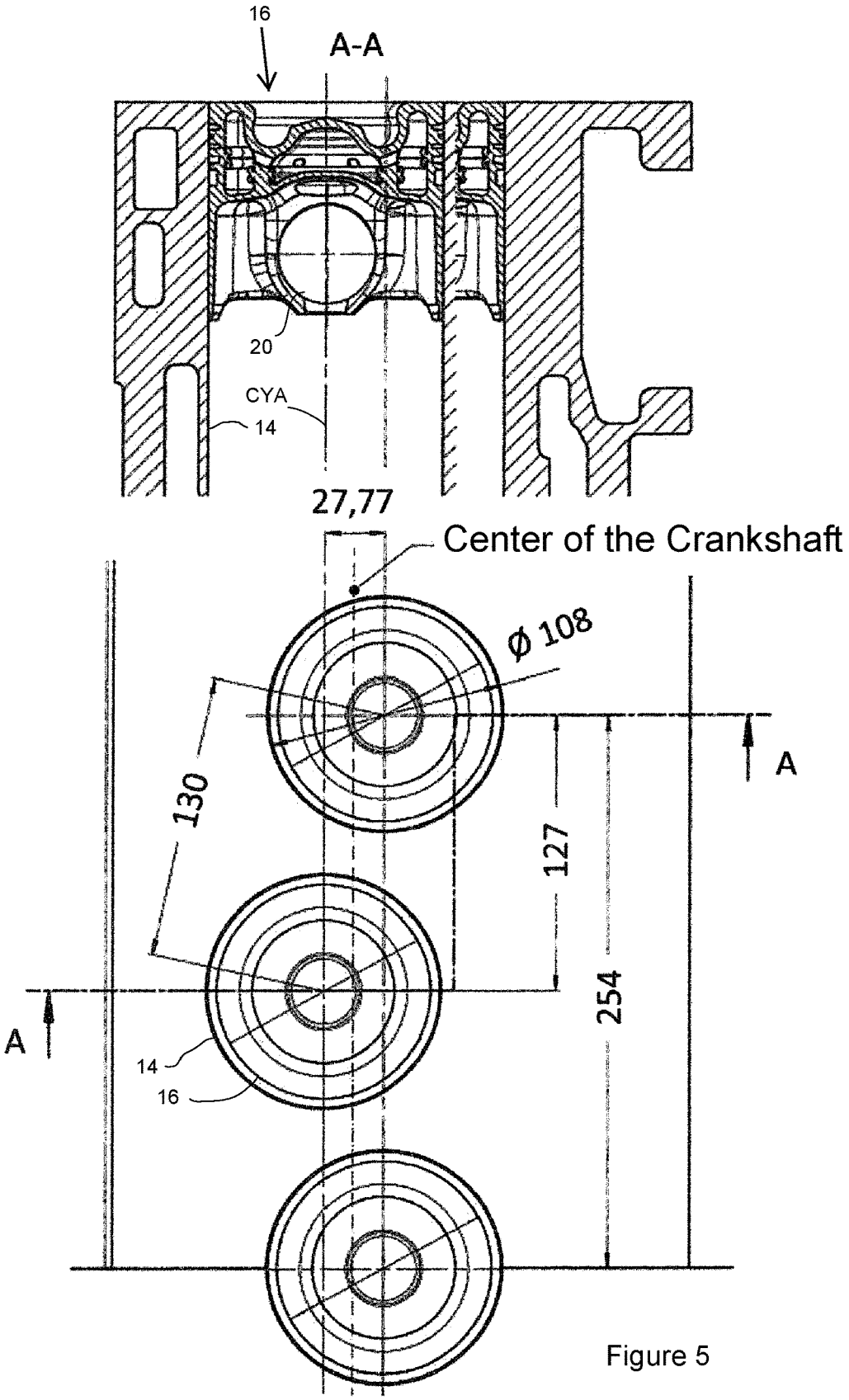
FIG. 5 twisting of the crank with a positive and a negative offset.

FIG. 5 shows a crank twisting with a positive and a negative offset, especially along the intersection line A-A. The bearing distances are decisive for the length of the engine, while the cylinder distance is decisive for the producibility and for the durability. The cylinders 14 run in parallel, as a result of which there is no additional need to attain smoothness of running for the engine, as is the case with V-engine models. In the case of the present invention, the center of the crankshaft does not have to run in the center through the offset cylinders 14. A unilateral offset, for instance, of +18 mm for cylinder line 1 and an offset of −10 mm for cylinder line 2, can be advantageous in terms of friction losses. The offset of the cylinders 14 in the concrete example of FIG. 5, about 28 mm, can be divided as described above. The greater cylinder distance entails additional advantages in terms of the degrees of design freedom, also when it comes to the cylinder head and the cylinder head gasket.

What is claimed is:

1. A reciprocating internal combustion engine comprising:

a line of cylinders arranged in parallel which are joined via connecting rods and pistons by a crank drive jointly mounted in a crankshaft bearing, the crankshaft bearing being offset relative to a respective cylinder axis of each of the cylinders such that each of the cylinders is laterally offset from a center of a same crankshaft of the crank drive, the cylinders alternatingly having a positive offset and subsequently a negative offset from the center of the same crankshaft, as seen in a lengthwise direction of the internal combustion engine.

2. The reciprocating internal combustion engine according to claim 1, wherein the pistons are joined to the connecting rod by a piston pin arranged in such a way that the piston pin is situated outside of a mid-plane of the piston.

3. The reciprocating internal combustion engine according to claim 1, wherein the pistons are joined to the connecting rod by a piston pin arranged in such a way that the piston pin is situated outside of a mid-plane of the piston on the counter-pressure side.

4. The reciprocating internal combustion engine according to claim 1, wherein the pistons are joined to the connecting rod by a piston pin arranged in such a way that the piston pin is situated outside of a mid-plane of the piston on the pressure side.

5. The reciprocating internal combustion engine according to claim 1, wherein each cylinder is equally spaced throughout the line of cylinders forming a cylinder distance and a bearing distance when twisted.

6. The reciprocating internal combustion engine according to claim 5, wherein the bearing distance is 127 mm between the crankshaft bearing and the at least one of the cylinders.

7. The reciprocating internal combustion engine according to claim 5, wherein the cylinder distance is 130 mm between each cylinder.

8. The reciprocating internal combustion engine according to claim 1 wherein the positive offset is a different distance than the negative offset.

9. The reciprocating internal combustion engine according to claim 8 wherein a distance of the positive offset is greater than a distance of the negative offset.

* * * * *